United States Patent [19]

Hartness et al.

[11] 4,126,163

[45] Nov. 21, 1978

[54] CENTERING DEVICE FOR BOTTLE FILLING MACHINES

[76] Inventors: Thomas P. Hartness, 305 Bridgewater Dr.; Robert G. Hartness, 203 Wilmington Rd., both of Greenville, S.C. 29607

[21] Appl. No.: 769,581

[22] Filed: Feb. 17, 1977

[51] Int. Cl.[2] ..... B67C 3/26

[52] U.S. Cl. ..... 141/269; 141/371

[58] Field of Search ..... 141/165, 166, 168, 171, 141/172, 269, 275–278, 281, 286, 311, 312, 369–374, 392

[56] References Cited

U.S. PATENT DOCUMENTS

| | | | |
|---|---|---|---|
| 3,048,206 | 8/1962 | Keller et al. | 141/371 |
| 3,841,364 | 10/1974 | Heckmann et al. | 141/392 |
| 4,014,372 | 3/1977 | Dichiara | 141/392 |

*Primary Examiner*—Richard E. Aegerter

*Assistant Examiner*—Frederick R. Schmidt

*Attorney, Agent, or Firm*—Bailey, Dority & Flint

[57] ABSTRACT

A bottle centering and sealing device for use on a bottle filling machine which includes a centering cup having a nonmetallic housing with a conical shaped recess in the bottom thereof. A cylindrical seal is carried adjacent the top of the recess which provides a seal between the top of the bottle and the bottom of a filling tank when the bottle is raised for filling liquid therein. The centering cup is supported on a horizontally extending arm which rides up vertically on a guide rail. The centering cup is loosely carried within the horizontal arm for aiding in aligning the bottle relative to the filling spout and vent tube forming part of the filling mechanism. A bearing is interposed between said arm and said guide rail for producing a retarding force against the raising of said centering cup when a bottle strikes said centering cup off center.

9 Claims, 5 Drawing Figures

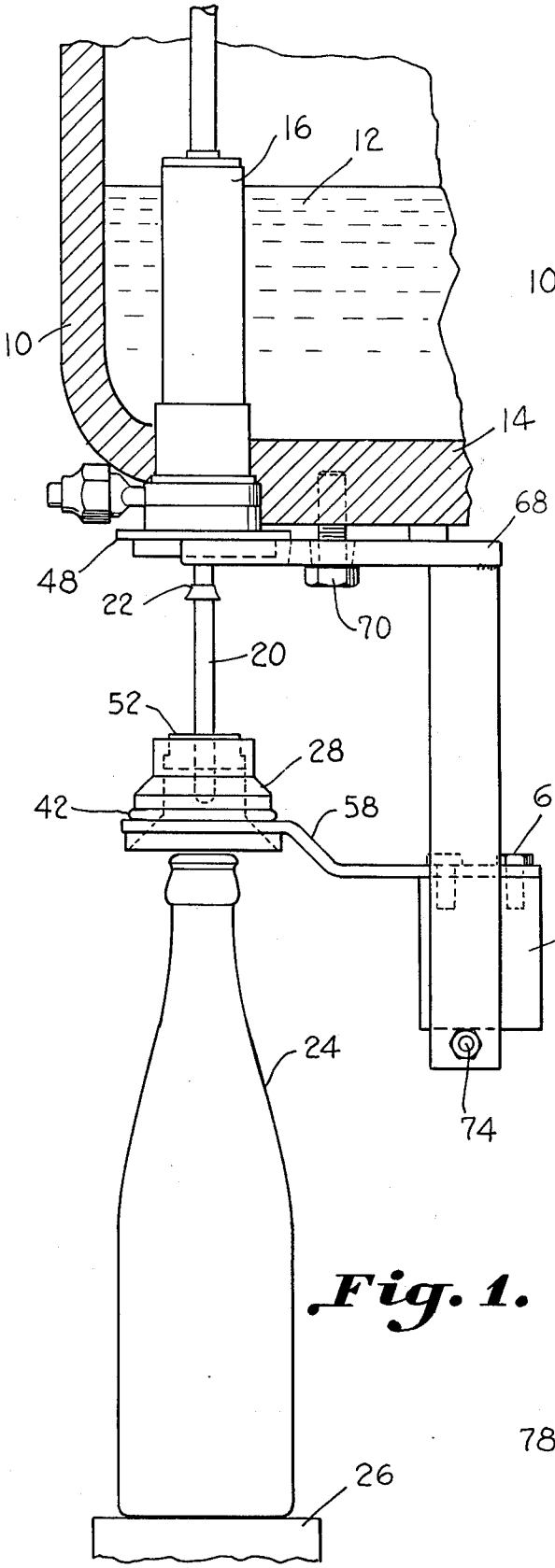
Fig. 1.
Fig. 2.
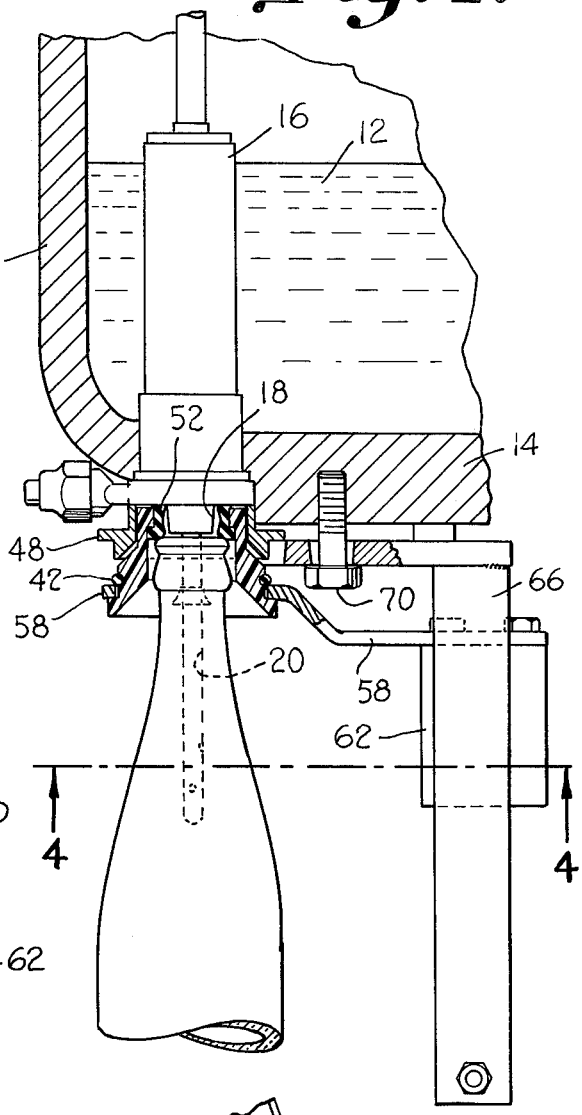
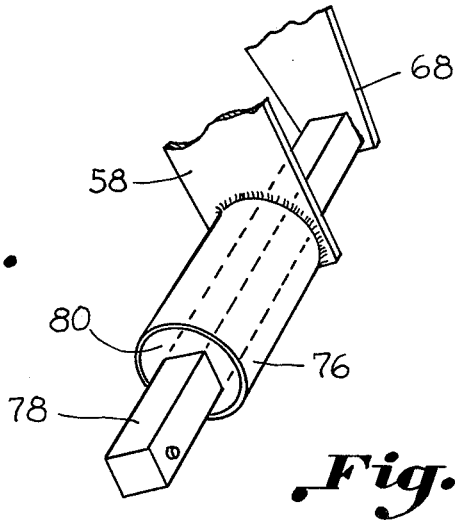
Fig. 5.

CENTERING DEVICE FOR BOTTLE FILLING MACHINES

BACKGROUND OF THE INVENTION

The present invention relates to a bottle centering device and more particularly to a bottle centering device which positively centers and seals a bottle relative to a filling valve forming a part of a beverage filling machine.

Most bottle filling machines utilize a stirrup for lifting a bottle up to a filling valve that has a small protruding vent tube that must extend into the mouth of the bottle so as to remove air from the bottle as the bottle is being filled. Some of these machines are equipped with centering devices which aid in shifting the bottles on the stirrups as they are raised to the filling position in order to insure that the tops of the bottles do not strike the vent tubes. An example of a bottle aligning device is disclosed in U.S. Pat. No. 3,742,989. In this particular device, a centering cup engages the shoulder of the bottle as it is raised to the filling position for aligning the bottle relative to the filling valve and the vent tube. One problem with such a device is that it will not accommodate short-necked bottles.

Another example of a bottle centering device is disclosed in U.S. Pat. No. 3,856,059 wherein as the bottle is raised it engages a centering device that is pivoted rearwardly out of the path of the bottle as the bottle is lifted to its filling device.

U.S. Pat. No. 3,048,206 discloses another centering device that is supported on a pair of pivotal arms. As a result of the centering cup being supported on pivotal arms, as the cup is raised it moves about a radius rather than on a direct vertical line. This presents a problem in tolerances in that the centering cup and bottle have to first clear the bottom of the vent tube 16, then be raised without striking the spreader washer and subsequently be properly positioned relative to the fluid valve.

The most commonly used centering device known to applicant is disclosed in U.S. Pat. No. 2,640,640 which includes a centering cup that is positioned directly adjacent the bottom of the filling tank. One problem with such devices is that the centering of the bottle does not place until after the vent tube has entered the neck of the bottle. If the bottle is not properly aligned, it could bend the vent tube as well as chip or break the top of the bottle.

Still another example of a centering device is disclosed in U.S. Pat. No. 3,183,964 wherein a centering cup is carried directly on a filling tube 11.

In U.S. Pat. No. 3,580,299 instead of raising the bottles to a filling valve, the entire filling mechanism is lowered down on the top of the bottle.

It is important that a satisfactory device be used for positioning the mouth of the bottle in proper position to accept the vent tube. If not, the bottle is often knocked off the stirrup by the mouth missing the vent tube, the bottle is broken by striking the vent tube and/or the bottle can be cracked. If the bottle is cracked it can explode when pressure is applied thereto during the filling operation. When the bottle crown ring is chipped on contact with the vent tube, such, in turn, can cause the rubber or plastic seals that are provided for holding the pressure as the bottle is being filled, to be cut.

These malfunctions are not only expensive as a result of loss of bottles, but interfere with production rates.

SUMMARY OF THE INVENTION

The invention pertains to a bottle centering and sealing device for use on a bottle filling machine which is provided with a filling tank. A filler valve is carried in the bottom wall of the filling tank with the vent tube projecting vertically below the bottom wall of the tank. A platform is used for elevating a bottle which is to be filled vertically to a filling position wherein the vent tube is inserted within the neck of the bottle and the top of the bottle is in alignment with a filling valve. The centering device includes a centering cup which has a housing with a recess provided therein for receiving a top of a bottle when elevated on the platform. The recess has a conical shaped portion adjacent the bottom of the housing which terminates in a cylindrical portion adjacent the top thereof. The conical shaped portion is inclined inwardly from the bottom of the housing toward the top of the housing. A sealing ring is carried within the cylindrical portion of the housing and provides a seal between the top of the bottle and the tank when the bottle is raised to the filling position. A horizontally extending arm is utilized for supporting the centering cup. The inner end of the horizontally extending arm has an opening therein slightly larger than an external surface on the housing for receiving the housing. An O-ring is utilized for loosely securing the housing to the inner end of the arm within the opening for aiding in aligning the top of the bottle in the housing when the bottle is raised for filling. The other end of the arm rides up and down on a vertically extending guide bracket. A bearing is interposed between the other end of the horizontally extending arm and the guide bracket for producing a low friction contact between the arm and the guide bracket when the bottle is properly aligned.

However, when the bottle strikes the centering cup off center on the inclined surface of the housing the bearing tends to bind against the guide bracket. This retarding force causes the bottle to slide over the inclined surface to the center of the cup.

Accordingly, it is an important object of the present invention to provide a centering cup which can be utilized with many different types and styles of bottles for centering the bottles relative to vent tubes and filling valves associated with filling machines.

Still another important object of the present invention is to provide a centering cup which aligns a bottle relative to a vent tube and other filling components as the bottle is raised vertically on a stirrup.

Still another important object of the present invention is to provide a centering cup which is permitted to be raised vertically along with a bottle as it moved to its filling position.

Still another important object of the present invention is to provide a centering cup which minimizes the chance of the bottle hanging up in the filling valve and centering cup as the bottle is lowered after filling.

Still another important object of the present invention is to provide a centering cup which aids in aligning bottles relative to a filling mechanism in addition to producing a positive seal between the top of the bottle and the filling mechanism.

Still another important object of the present invention is to provide a bottle centering and sealing device which substantially eliminates the problem of aligning the open tops of bottles with the filling mechanism.

These and other ojects and advantages of the invention will become apparent upon reference to the following specification, attendant claims, and drawings.

BRIEF DESCRIPTION OF THE DRAWINGS

FIG. 1 is an elevational view ilustrating a bottle centering and sealing device constructed in accordance with the present invention mounted for use on a bottle filling machine, FIG. 2 is a sectional view of the bottle centering and filling device of FIG. 1, FIG. 5 is an alternate embodiment of a guide bracket upon which the centering cup is raised and lowered.

DESCRIPTION OF A PREFERRED EMBODIMENT

Figure 3:
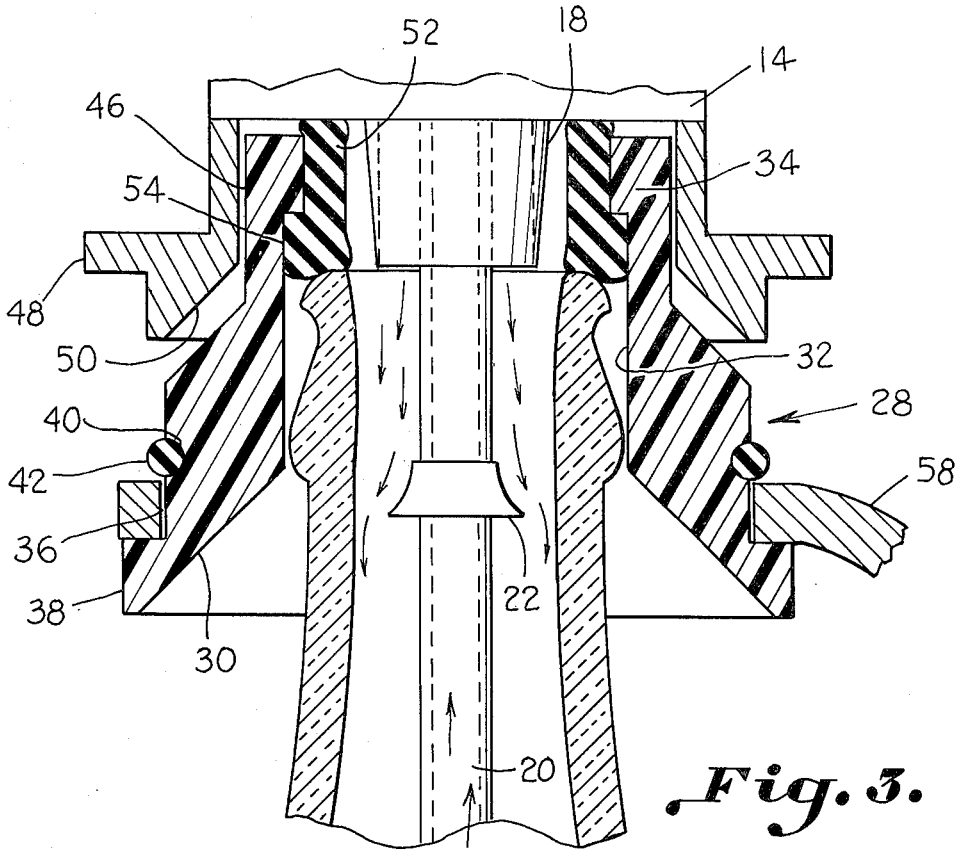
FIG. 3 is an enlarged sectional view illustrating a centering device constructed in accordance with the present invention.
Figure 4:
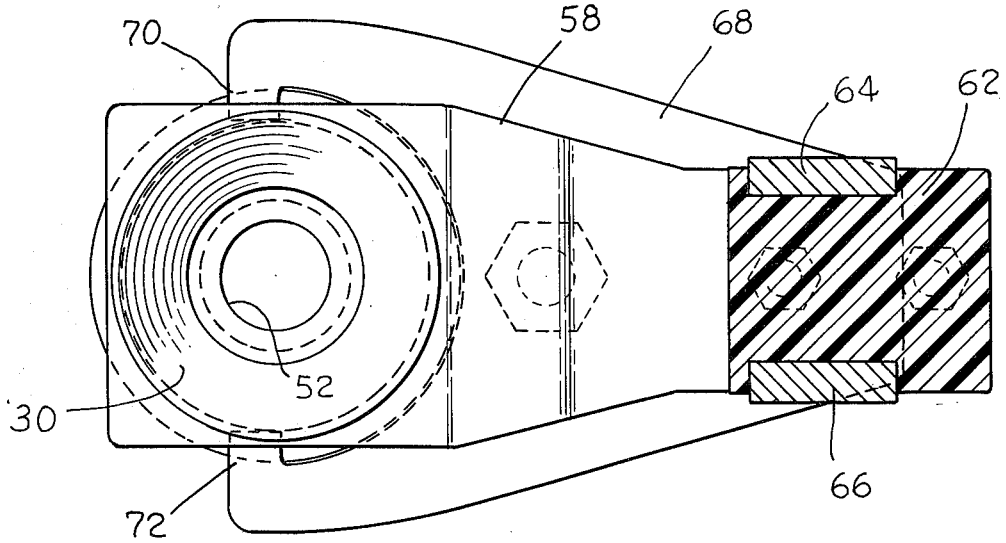
FIG. 4 is a plan view partially in section, taken along the line 4—4 of FIG. 2.

Referring to FIG. 1 of the drawing, there is illustrated a bowl or tank 10 of a bottle filling machine having liquid 12 carried therein. Extending through a bottom wall 14 of the tank is a valve mechanism 16 which dispenses the liquid from the tank. The valve mechanism 16 may be any suitable conventional construction, and one suitable valve is described in more detail in U.S. Pat. No. 3,046,027. A similar valve and mechanism for operating the valve is disclosed in U.S. Pat. No. 3,500,880. A nipple 18 is carried adjacent the bottom of the valve for dispensing the liquid from the tank into a bottle upon activating the valve mechanism 16. Extending downwardly through the bottom of the tank 14 and the nipple 18 is a vent tube 20 which allows the air to escape from the bottle during the filling operation. As the liquid is dispensed through the nipple 18 into the bottle it strikes a spreader washer 22 which causes the liquid to run down the inner walls of the bottle during the filling operation.

In normal operation of the bottle filling machine, a bottle 24 is supported on a stirrup 26 which automatically raises the bottle upwardly to the bottom of the tank so that the liquid can be dispensed therefrom through the valve mechanism into the bottle. In placing the bottles 24 on the stirrups 26 they are often not in proper alignment with the filling valve and vent tube 20. As a result, as the bottle is raised the bottle will strike the vent tube causing one or more of the following malfunctions. When the bottle strikes the vent tube it can be knocked off the stirrup 26 by the mouth missing the vent tube, the bottle can be broken by striking the vent tube, the bottle can be cracked on striking the vent tube which could cause the bottle to explode when pressure is applied during filling, the bottle crown ring can be chipped on contact with the vent tube causing cutting of the rubber or plastic seals normally provided with the filling mechanism, and/or the bottle can strike the spreader washer which, in turn, would affect the flow of liquid into the bottle. Some times when the bottle strikes the vent tube it will bend the vent tube badly often destroying it.

These malfunctions are not only expensive as a result of loss of bottles, fluid and machine parts, but also affect the production rate of the filling machine.

The centering and sealing device constructed in accordance with the present invention includes a plastic housing 28 which may be constructed of any suitable material such as nylon and has an inclined conical shaped inner wall 30 which defines a conical shaped recess that terminates in a cylindrical recess defined by the cylindrical wall 32. A radially extending flange 34 is provided adjacent the top of the inner wall of the housing.

The outer wall of the housing 28 has a reduced cylindrical surface 36 directly adjacent an outwardly extending wall portion 38 that is provided adjacent the bottom of the housing. Positioned directly above the reduced surface 36 is a groove 40 in which an O-ring 42 is carried.

The upper part of the housing tapers inwardly and terminates in a reduced diameter cylindrical portion 46 which is adapted to fit within a cylindrical opening provided in an aligning ferrule 48 which is carried on the bottom of the filling tank. The aligning ferrule 48 has a conical inner surface 50 provided adjacent the bottom of the inner wall 50. A flexible relatively hard rubber cylindrical seal 52 is carried within the upper portion of the housing and has a radially extending flange 54 which abuts against the flange 34 of the housing for securing the seal therein. The seal 52 extends upwardly beyond the top of the housing 28 as best illustrated in FIG. 3. The seal has a cylindrical opening therein through which nipple 18 extending downwardly from the bottom of the filling tank passes.

A horizontally extending arm 58 is provided for supporting the housing 28. The arm 58 has a hole provided in an inner end thereof so that the housing can slip therethrough and be secured thereto between the O-ring 42 and the outwardly extending flange 38 provided adjacent the bottom of the housing. The opening is slightly greater than the external diameter of the reduced portion 36 of the housing so that there is a loose fit therebetween. In one particular embodiment there is a difference of one thirty-second inch between the external diameter of the reduced portion 36 and the diameter of the hole carried in the horizontal arm 58. The loose fit between the arm and the housing 26 permits the centering cup to continue operating properly and prevents it from hanging up in the aligning ferrule 48 even if the cup assembly becomes slightly out of alignment.

The horizontally extending arm 58 has its inner end secured by means of bolts 60 to the top of a substantially H-shaped nylon bearing block 62. The nylon block 62 is positioned between a pair of laterally spaced vertically extending guide rails 64 and 66. The upper ends of the guide rails 64 and 66 are welded to a horizontally extending member 68 which is bolted to the bottom of the tank 14 by means of a bolt 71. The inner end of the horizontally extending member 68 has a semicircular recess provided therein with a pair of inwardly extending flanges 70 and 72. The inwardly extending flanges 70 and 72 engage the radially extending flange of the aligning ferrule 48 holding the aligning ferrule in position adjacent the bottom of the filling tank.

A bolt 74 extends between the guide rails 64 and 66 adjacent the bottom thereof for securing the nylon block between the guide rails 64 and 66.

In operation, as the stirrup 26 is raised, lifting the bottle 24 upwardly if the bottle is out of alignment with the vent tube 20 it strikes the incline edge 30 of the inner wall of the housing 28 and is forced to the center of the housing 28. The bottle continues rising until the top thereof engages a bottom surface of the seal 52. At this time, the entire centering cup begins to rise in a vertical path provided by the guide rails 66 and 64 and the nylon block carried therebetween. When it is raised to its filling position, such as illustrated in FIG. 2, the top of the bottle presses against the bottom of the seal 52 with the top of the seal presses against the bottom of the filling tank. As a result of the relatively narrow surface of the seal 52, the pressure required to make the seal between the top of the bottle and the bottom of the tank is reduced as compared to that normally required with most bottle filling apparatus.

When the bottle reaches the filling position the liquid flows through the nozzle 18 engaging the spreader washer 22 and is directed along the inner walls of the bottle 24. After the bottle has been filled, the stirrup 26 begins lowering the bottle 24. When the guide block 62 strikes the bolt 74 carried between the guide rails 64 and 66, the downward descent of the centering cup stops abruptly causing the momentum of the bottle to pull the bottle from the rubber seal 52 minimizing the possibility of the bottle hanging up therein.

As a result of the H-shaped configuration of the block 62 and the nesting of the guide rails 64 and 66 in the slots provided therein, a retarding force is normally applied to the centering cup until the bottle has been properly centered. If the bottle engages the inclined inner wall 30 of the centering cup, it tends to cause binding between the H-shaped block 62 and the guide rails 64 and 66 until it is shifted to the center of the cup wherein it engages the seal 52. In one particular embodiment the inner wall 30 extends upwardly and inwardly at an angle of approximately 45°. The external diameter of the reduced surface 36 is 1 and 31/32 inches wherein the internal diameter of the hole provided in the inner end of the horizontally extending arm 58 is 2 inches in diameter. It is also noted that the O-ring 42 is positioned slightly above the arm 58 so as to provide a loose fit between the arm 58 and the centering cup.

In order to remove the centering cup, it is only necessary to slip the flexible O-ring 42 out of the groove and drop the entire housing 28 through the hole provided in the arm 58. The plastic housing 28 of the centering cup may be constructed of any suitable material such as Delron, manufactured by E. I. Dupont Co., high molecular weight polyethylene or nylon. As a result of the inclined surface 30 being of a plastic material, the bottle tends to slide thereacross with a minimum amount of friction and binding during the centering operation prior to being shifted upwardly to engage the sealing washer 52.

FIG. 5 illustrates an alternate embodiment for the guide rails 64 and 66. In the device shown in FIG. 5, the inner end of the arm 58 is welded to a sleeve 76 that encircles a square-shaped shaft 78. The upper end of the shaft 78 is welded to the same horizontal member 68. Positioned within the sleeve 76 is a bearing member 80 which has a square-shaped hole provided therein permitting the sleeve 76 and the arm 58 to ride up and down on the shaft during the filling operation similar to that described in connection with the block 62. In one particular embodiment the bearing material includes a woven teflon dacron fabric with a fiberglass resin backing. As a result of the bearing material 80 carried within the sleeve 76 there is relatively low frictional contact between the bearing material and the shaft 78 permitting the arm 58 to be raised and lowered on the shaft 78 when the bottle is properly aligned. There is, however, a retarding force imparted to the cup when the bottle is not properly centered which aids in centering the bottle. It is to be understood, of course, that other types of conventional bearing material could be utilized.

Another advantage of the centering cup constructed in accordance with the present invention is that prior to the bottle being raised it acts as an umbrella over the top of the bottle so that in the event that an adjacent bottle explodes causing glass to be thrown, the centering cup would minimize the chances of the glass entering into the bottle.

While a preferred embodiment of the invention has been described using specific terms, such description is for illustrative purposes only, and it is to be understood that changes and variations may be without departing from the spirit or scope of the following claims.

What is claimed is:

1. A bottle centering and sealing device for use on a bottle filling machine provided with a filler tank, wherein a filler valve is carried in a bottom wall of said tank with a vent tube projecting vertically below said bottom wall of said tank, and wherein a platform is positioned below said filler valve which is elevated for vertically raising a bottle carried thereon to a filling position for being filled with liquid flowing through said filler valve from said tank, said bottle centering device comprising:

(a) a centering cup having a housing with a recess provided therein for receiving a top of a bottle when elevated on said platform;

(b) said recess having a conical shaped portion adjacent the bottom of said housing which terminates in a cylindrical upper portion, said conical shaped portion being inclined inwardly from the bottom of said housing towards the top of said housing;

(c) sealing means carried in said housing providing a seal between the top of said bottle and said tank when said bottle is in a filling position;

(d) a horizontally extending arm having one end supporting said centering cup;

(e) a vertically extending guide bracket;

(f) bearing means interposed between said vertically extending guide bracket and the other end of said arm permitting said centering cup and said horizontally extending arm to be raised in a direct vertical line by said bottle as said bottle is raised on said platform to a filling position;

whereby said bottle is aligned with said filler valve by said centering cup as the bottle is raised to said filling position.

2. The bottle centering and sealing device as set forth in claim 1 wherein said sealing means comprises:

(a) a flexible cylindrically shaped seal carried in said cylindrical upper portion of said housing with substantially flat upper and lower end surfaces;

(b) said upper end surface of said seal extending upwardly beyond said housing;

whereby when said bottle is raised to the filling position the top of said bottle engages said bottom surface of said seal providing a seal therebetween and forcing the upper end surface of said seal flush against the bottom of said tank providing a seal therebetween.

3. The bottle centering device as set forth in claim 2 wherein said housing is constructed of plastic material so that when centering an improperly aligned bottle the top of the bottle slides over said plastic conical shaped portion towards the center of said housing.

4. The bottle centering and sealing device as set forth in claim 1 wherein said vertically extending guide bracket comprises:

(a) a pair of vertically extending laterally spaced posts:

(b) said bearing means including:

(i) a substantially H-shaped block which nests between said laterally spaced posts and rides up and down on said vertically spaced post, and (c) means for attaching said other end of said horizontally extending arm to said block.

5. The bottle centering and sealing device as set forth in claim 1 wherein said vertically extending guide bracket comprises:

(a) a vertically extending post laterally spaced from said bottle out of the path traveled by said bottle when being raised to a filling position;

(b) a sleeve surrounding said post;

(c) means for attaching said other end of said arm to said sleeve; and (d) a low friction bearing interposed between said post and said sleeve for permitting said sleeve to be readily raised and lowered on said post.

6. The bottle centering device as set forth in claim 1 wherein:

(a) said one end of said horizontally extending arm has an opening therein slightly larger than an external surface of said housing for receiving said housing; and (b) means for loosely securing said housing to said one end of said arm within said opening for aiding in aligning said top of said bottle in said housing when said bottle is raised for filling.

7. The bottle centering device as set forth in claim 6 comprising:

(a) a radially extending flange carried on the outer surface of said housing adjacent the bottom thereof which abuts against a lower surface of said arm;

(b) a reduced portion provided on the outer surface of said housing adjacent said flange for extending through said hole in said arm;

(c) a cylindrical groove provided in the outer surface of said housing directly above said reduced portion; and (d) a removable retaining ring carried in said groove for loosely secured said housing to said arm with said radially extending flange positioned on one side of said arm and said retaining ring on the other side.

8. The bottle centering device as set forth in claim 1 wherein said vertically extending guide bracket is metallic and said bearing means is a non-metallic member.

9. A bottle centering and sealing device for use on a bottle filling machine provided with a filler tank, wherein a filler valve is carried in a bottom wall of said tank with a vent tube projecting vertically below said bottom wall of said tank, and wherein a platform is positioned below said filler valve which is elevated for vertically raising a bottle carried thereon to a filling position for being filled with liquid flowing through said filler valve from said tank, said bottle centering device comprising:

(a) a centering cup having a housing with a recess provided therein for receiving a top of a bottle when elevated on said platform;

(b) said recess having a conical shaped portion adjacent the bottom of said housing which terminates in a cylindrical upper portion, said conical shaped portion being inclined inwardly from the bottom of said housing towards the top of said housing:

(c) sealing means carried by said housing providing a seal between the top of said bottle and said tank when said bottle is in a filling position;

(d) a horizontally extending arm having one end supporting said centering cup;

(e) a vertically extending guide bracket; and (f) vertically elongated bearing means interposed between said vertically extending guide bracket and the other end of said arm producing a retarding force against the raising of said centering cup when a bottle strikes said centering cup off center and permits said centering cup to rise freely when said bottle is properly aligned is said centering cup.

* * * * *